United States Patent [19]

Piscitelli et al.

[11] 4,431,256

[45] Feb. 14, 1984

[54] SPLIT SLEEVE SOCKET CONTACT

[75] Inventors: R. Amelia Piscitelli; Valentine J. Hemmer, both of Sidney; David O. Gallusser, Oneonta, all of N.Y.

[73] Assignee: The Bendix Corporation, Southfield, Mich.

[21] Appl. No.: 317,828

[22] Filed: Nov. 3, 1981

[51] Int. Cl.[3] ..... H01R 13/12

[52] U.S. Cl. ..... 339/258 R

[58] Field of Search ..... 339/258 R, 258 A, 258 C, 339/258 P, 258 RR, 258 T

[56] References Cited

U.S. PATENT DOCUMENTS

| | | | |
|---|---|---|---|
| 3,286,222 | 11/1966 | Drinkwater | 339/258 R |
| 3,406,376 | 10/1968 | Varrin | 339/258 R |
| 3,564,487 | 2/1971 | Upstone et al. | 339/258 R |

FOREIGN PATENT DOCUMENTS

| | | | |
|---|---|---|---|
| 1139171 | 11/1962 | Fed. Rep. of Germany RR | 339/258 |
| 2614210 | 10/1977 | Fed. Rep. of Germany RR | 339/258 |
| 944875 | 11/1948 | France | 339/258 R |
| 1447759 | 6/1966 | France | 339/258 R |

*Primary Examiner*—Joseph H. McGlynn

*Attorney, Agent, or Firm*—John R. Benefiel; Raymond J. Eifler

[57] ABSTRACT

An electrical split sleeve socket contact (10) is disclosed including a plurality of tines (26) formed by slots (30) axially extending from the front of a contact sleeve (12) in which an increased contact pressure is achieved by an axially extending central rib (44) and inwardly crimped sides (46) of each of the contact tines (26) to provide three line contact of each tine with the pin contact (22) and increase the flexural rigidity of each of the tines (26) (FIG. 3).

5 Claims, 5 Drawing Figures

SPLIT SLEEVE SOCKET CONTACT

This invention concerns electrical contacts for an electrical connector and more particularly split sleeve socket type contacts adapted to receive a pin type contact in order to establish an electrical connection therebetween.

Such socket contacts as heretofore been known consist of a generally cylindrical liner or contact sleeve which is disposed within an outer confining hood. The contact sleeve is formed with a series, usually a pair, of radially opposed slots extending axially for a portion of the length of the contact sleeve. The slots form a series of contact tines which are configured to received the pin contact and to separate from each other under the pressure of contact with the pin, to establish a contact pressure on the pin and also creating a retention force which establish and maintains an electrical connection therebetween.

The rear portion of the contact liner sleeve is adapted to be electrically connected to a wire conductor, typically by means of a crimped or soldered connection. The contact of that type is disclosed in U.S. Pat. No. 4,278,317 issued July 14, 1981 for a "Formed Socket Contact with Reinforcing Ridge".

The socket contact disclosed in that patent is concerned with miniature sized socket contacts of formed construction, in which a thin sheet spring metal material is rolled to form the contact at relatively moderate manufacturing costs. As discussed in the aforementioned patent, there is difficulty in achieving adequate contact pressure for such small size contacts due to inadequate rigidity of the thin metal employed in manufacturing the contact sleeve. According to the arrangement of that invention, a longitudinal rib or ridge is formed in each of the contact tines extending partially along the length of the tine and discontinued at the front most portion. In that design the pin contact does not make contact with the rib but rather with the adjoining side interior surfaces adjacent to the rib, the rib serving to stiffen each tine, increasing its flexural rigidity with a resultant increase in contact pressure. The result of this configuration is a relatively enlarged section at the front of the contact which the pin contact does not engage upon insertion. Under high temperature and vibration conditions, the contact resistance may become excessive and/or these conditions may result in an electrical discontinuity across the contact assembly.

DISCLOSURE OF THE INVENTION

The present invention provides a split sleeve socket type contact with improved contact pressure and increased surface area engagement in the contact, to reduce resistance across the contact assembly, as well as to improve the rigidity of the contact tines to improve performance under high temperature and vibration conditions.

This is achieved by a split sleeve socket contact characterized by each of the tines having an axially extending central rib which extends the full length of the rib and configured to produce a line of contact with the contact pin along the inside surface of the rib. The socket contact is also characterized by having the lateral sides thereof each inwardly crimped to cause the edges to contact the contact pin, so that altogether there are three lines of contact between with the pin contact and also to increase the flexural rigidity of the tine to increase the contact force as well as the contact area. Inward crimping of the sides may extend along the full length of the slots, in which case a transverse relief cut out is provided at the root of each slot in order to accomodate the inward crimping of the edge.

Alternatively, the crimping may be localized at the frontal area of each tine.

This three line contact configuration of the socket has the advantage of increasing the contact pressure and contact area in order to decrease the contact resistance and in order to improve the contact performance under high temperature and vibration conditions.

DETAILED DESCRIPTION OF THE INVENTION

For the sake of completeness a socket contact according to the construction of that patent has been here described but it should be understood that this is intended to be exemplary only and many variations of these features of the socket contact may be utilized with the tine geometry of the present invention.

Figure 1:
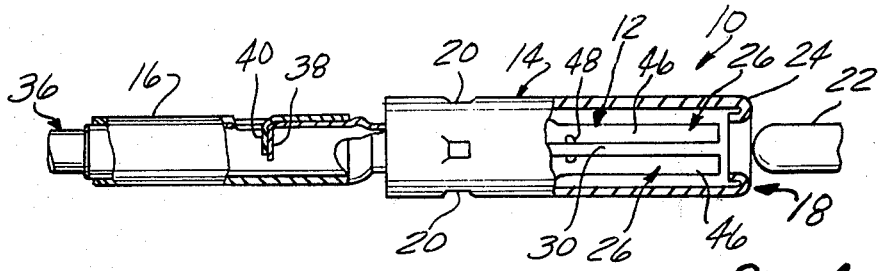
FIG. 1 is a partially sectional view of a socket contact according to the present invention.

FIG. 1 shows the complete assembly of the socket contact 10 includes a generally cylindrical inner contact sleeve 12, an outer surrounding jacket or hood 14, a rear sleeve 16. The hood 14 is telescopically received over the contact sleeve 12 as shown and may be crimped in position at 20 in order to secure the axial position on the contact liner 12.

The front end of the socket contact 18 of the socket contact 10 is adapted to receive a pin contact 22 as shown in fragmentary form in FIG. 1, and the front end of the hood 14 is crimped and formed inwardly at 24 to provide a suitable guiding surface to ease entry of the rounded front end of the pin contact 22. A pair of tines 26 are shown in FIG. 1 which are formed by a pair of end wise axially extending slots 30. The forward end of the contact sleeve 12 and the tines 26 are spaced slightly from the inside of the crimped front end of the hood 14 in order to allow axial separation therebetween upon insertion of the pin contact 22.

The rear sleeve 16 is received over the rear of contact sleeve 12 and is adapted to receive a conductor wire 36 with the contact sleeve 12 and rear sleeve 16 both having inwardly crimped tabs 38 and 40, respectively, which serve as stops for the wire conductor 36. The wire conductor 36 is adapted to be crimped onto the rear of the socket contact 10, as by crimping with the rear end of the contact sleeve, which is configured so as to achieve good electrical contact by the crimping process as well as retaining force, as described more completely in the aforementioned U.S. Pat. No. 4,278,317.

Figure 2:
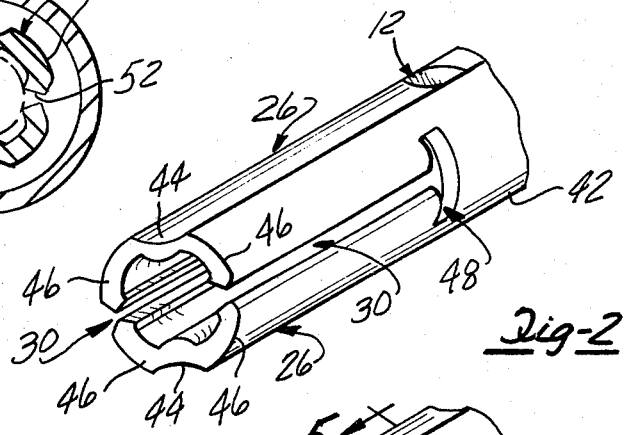
FIG. 2 is a fragmentary perspective view of a contact sleeve according to a first embodiment of the invention as shown in FIG. 1.

FIG. 2 reveals the details of the contact sleeve 12 front portion thereof which includes a body section 42 of cylindrical configuration which is sized to be telescopically received the hood 14 and crimped thereto as described above, on a body section 42 is located to the rear of the tines 26. The tines 26 are each created by axially extending slots 30 extending from the forward portion of the contact sleeve 12 rearwardly to the body section 42. Each of the contact tines 26 is also provided with an axially extending inwardly formed rib 44 extending the entire length of the forward portion of the contact sleeve 12 into the region of the body section 42. Contact tines 26 are each formed with inwardly crimped sides 46 which are thereby radially deformed inwardly from the cylindrical shaped body section 42. Transverse relief slots 48 accommodate the radially inward crimping of each of the sides 46.

Thus a generally U-shaped tine 26 is provided which a produces three lines of contact with the contact pin 22 upon insertion.

Figure 3:
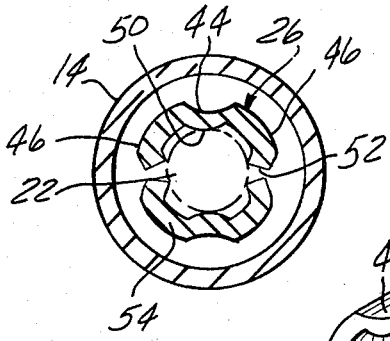
FIG. 3 is a transverse sectional view taken along lines 3—3 through the socket contact depicted in FIG. 1.

FIG. 3 shows the relationship between the pin 22 and each of the tines 26 upon insertion. The inside surface of the rib 44 produces a line of contact, and the crimping of each of the sides 46 produces a line 26 contact on each inside edge 52 on the exterior of pin contact 22.

The hood 14 is of greater diameter than the outside diameter of the contacts 26 in their spread apart condition such that a clearance space 54 exists which allows free separation of the tines 26.

The three line contact as well as the increased stiffness of the tines 26 in bending creates a higher contact pressure and an increase in contact area such as to improve or lower the resistance of the contact even under high temperature and vibration conditions such as to enable adequate performance even under high these conditions.

Figure 4:
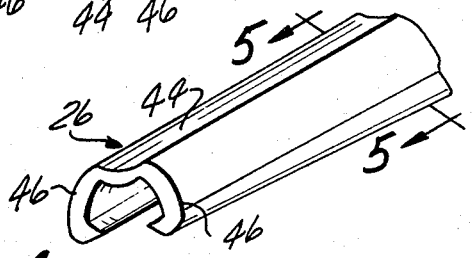
FIG. 4 is a fragmentary perspective view of an alternate embodiment of the contact sleeve.

FIG. 4 shows an alternative construction in which the crimped sides 46 are located in a localized region at the very front most end of the tines 26, the remaining portion of the contact tines sides being generally cylindrical.

Figure 5:
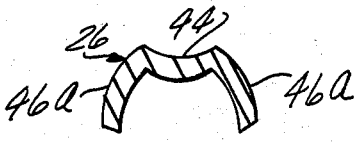
FIG. 5 is a transverse sectional view taken through the contact sleeve of FIG. 4.

FIG. 5 shows the rear portion of the sides 46A which are aligned with the the body section 42. This eliminates the need for a separate transverse slots 48, while also insuring three lines of contact of each tine 26 with the pin contact 22.

The present invention is concerned with the geometry of a split sleeve socket contact tines or fingers which are those portions of the socket contact which are directly engaged with the pin contact. Such split sleeve sockets contacts of course normally form a part of an electrical connector and are connected to a wire conductor and are possessed of suitable features for mounting in an electrical connector. These other features of the socket contact according to the present invention may be of conventional design, as in the aforementioned U.S. Pat. No. 4,278,317.

We claim:

1. In combination with a split sleeve socket contact of the type adapted to be mated with a pin contact and including a generally cylindrical contact sleeve being formed with a series of axially extending slots extending in from a front end of the contact sleeve to form a corresponding series of tines, and a surrounding hood sleeve, with the entire length of each of said tines being spaced from the inside of said hood sleeve, both with and without said pin contact inserted to enable radial separation of each tine upon insertion of a pin contact, the improvement wherein each of said tines is configured with an inwardly protruding axial rib extending to the front end thereof and a pair of radially inwardly crimped sides establishing three lines of contact with said pin contact upon insertion thereof; said tines being configured so that all portions thereof are moved radially outward upon insertion of said pin contact while maintaining said three lines of contact therewith, whereby said flexural rigidity of said tines and contact pressure is improved by said rib and said three line contact.

2. The split sleeve socket contact according to claim 1 wherein each of said radially inwardly crimped sides extends rearwardly of said contact sleeve and wherein said contact sleeve is further formed with a transverse relief slot located at the end of each of said slots to thereby accomodate radially inward crimping of said tine sides.

3. The split sleeve socket contact according to claim 1 wherein said radially inwardly crimped sides are formed at a localized region at the front end of said contact sleeve.

4. The split sleeve socket contact according to claim 1 wherein a pair of axially extending slots are formed in said contact sleeve to form a corresponding pair of opposed tines.

5. The split sleeve socket contact according to claim 1 wherein said contact sleeve is formed with a generally cylindrical body section to the rear of said tines, said body section telescopically receiving said hood thereover, and said hood being crimped to said body section of said contact sleeve.

* * * * *